US011254127B2

(12) United States Patent
Takahashi et al.

(10) Patent No.: US 11,254,127 B2
(45) Date of Patent: Feb. 22, 2022

(54) LIQUID EJECTING HEAD AND LIQUID EJECTING APPARATUS

(71) Applicant: SEIKO EPSON CORPORATION, Tokyo (JP)

(72) Inventors: Wataru Takahashi, Chino (JP); Hiroaki Okui, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/854,999

(22) Filed: Apr. 22, 2020

(65) Prior Publication Data

US 2020/0338890 A1 Oct. 29, 2020

(30) Foreign Application Priority Data

Apr. 25, 2019 (JP) ..... JP2019-083766

(51) Int. Cl.
*B41J 2/14* (2006.01)
*B41J 2/175* (2006.01)

(52) U.S. Cl.
CPC ..... *B41J 2/14201* (2013.01); *B41J 2/175* (2013.01)

(58) Field of Classification Search
CPC .... B41J 2/14201; B41J 2/175; B41J 2202/11; B41J 2/161; B41J 2/1623; B41J 2/1628; B41J 2/1629; B41J 2002/14419; B41J 2002/14491; B41J 2/14233
See application file for complete search history.

(56) References Cited

U.S. PATENT DOCUMENTS

2005/0036011 A1* 2/2005 Watanabe ..... B41J 2/14209 347/71
2017/0113462 A1 4/2017 Takahashi et al.

FOREIGN PATENT DOCUMENTS

JP 2017-080946 A 2/2017

OTHER PUBLICATIONS

IP.com search (Year: 2021).*

* cited by examiner

*Primary Examiner* — Lisa Solomon
(74) *Attorney, Agent, or Firm* — Workman Nydegger

(57) ABSTRACT

A liquid ejecting head includes a flow path substrate configuring a side face of a pressure chamber in communication with a nozzle through which a liquid is ejected, a diaphragm including a first face joined to the flow path substrate and a second face on an opposite side of the diaphragm to the first face, and a drive device provided on the second face and configured to change pressure in the pressure chamber. A corner of the side face of the pressure chamber includes a curved face having a center of curvature positioned in the pressure chamber in plan view, a recess is formed in the first face, and the pressure chamber is positioned inside the recess in plan view.

5 Claims, 5 Drawing Sheets

LIQUID EJECTING HEAD AND LIQUID EJECTING APPARATUS

The present application is based on, and claims priority from JP Application Serial Number 2019-083766, filed Apr. 25, 2019, the disclosure of which is hereby incorporated by reference herein in its entirety.

BACKGROUND

1. Technical Field

The present disclosure relates to a technique for ejecting a liquid such as an ink.

2. Related Art

Liquid ejecting heads that eject a liquid such as an ink through plural nozzles have been proposed. For example, JP-A-2017-080946 discloses a liquid ejecting apparatus including a pressure chamber-formed substrate in which a pressure chamber is formed, a diaphragm configuring part of a wall face of the pressure chamber, a piezoelectric element provided on the diaphragm to change the pressure inside the pressure chamber, and a communication substrate formed with a nozzle communication hole through which the pressure chamber and a nozzle communicate with each other. The diaphragm and the communication substrate are positioned on opposite sides of the pressure chamber-formed substrate such that the pressure chamber-formed substrate is interposed therebetween. The communication substrate and the pressure chamber-formed substrate are joined together using an adhesive.

However, in the technique of JP-A-2017-080946, the adhesive used to join together the pressure chamber-formed substrate and the communication substrate may travel along corners of the pressure chamber by capillary force and adhere to the diaphragm. Such adhesion of the adhesive may change the oscillation characteristics of the diaphragm, resulting in variation in nozzle ink ejection characteristics.

SUMMARY

A liquid ejecting head according to a preferable aspect of the disclosure includes a flow path substrate configuring a side face of a pressure chamber in communication with a nozzle through which a liquid is ejected, a diaphragm including a first face joined to the flow path substrate and a second face on an opposite side of the diaphragm to the first face, and a drive device provided on the second face and configured to change pressure in the pressure chamber. A corner of the side face of the pressure chamber includes a curved face having a center of curvature positioned in the pressure chamber in plan view, a recess is formed in the first face, and the pressure chamber is positioned inside the recess in plan view. The disclosure may also be conceived as a liquid ejecting apparatus including the liquid ejecting head and a controller that controls the liquid ejecting head.

DESCRIPTION OF EXEMPLARY EMBODIMENTS

A. First Embodiment

Figure 1:
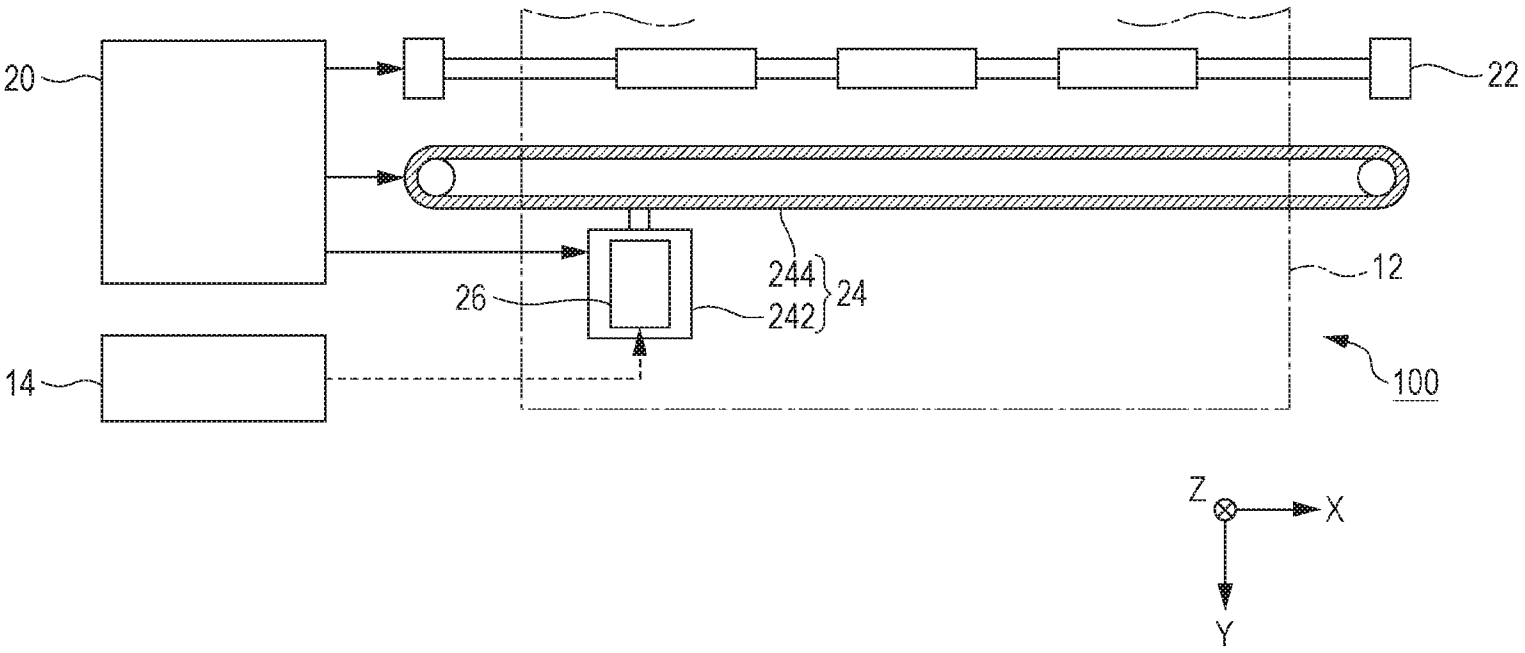
FIG. 1 is a configuration diagram of a liquid ejecting apparatus according to a first embodiment.

FIG. 1 is a configuration diagram illustrating an example of a liquid ejecting apparatus 100 according to a preferable embodiment of the disclosure. The liquid ejecting apparatus 100 of the present embodiment is an ink jet printing apparatus that ejects ink, serving as an example of a liquid, onto a medium 12. Although the medium 12 would typically be printing paper, any desired printing target material, such as a resin film, fabric, or the like, may be employed as the medium 12. As illustrated in FIG. 1, a liquid holder 14 in which ink is held is installed to the liquid ejecting apparatus 100. For example, a cartridge capable of being attached and detached with respect to the liquid ejecting apparatus 100, a bag-shaped ink bag formed from a flexible film, or a refillable ink tank may be employed as the liquid holder 14.

As illustrated in FIG. 1, the liquid ejecting apparatus 100 includes a control unit 20, a transport mechanism 22, a mover mechanism 24, and a liquid ejecting head 26. The control unit 20 includes a processing circuit configured by a central processing unit (CPU), a field-programmable gate array (FPGA), or the like, and a storage circuit configured by semiconductor memory or the like, and performs overall control of the respective elements of the liquid ejecting apparatus 100. The control unit 20 is an example of a controller. The transport mechanism 22 transports the medium 12 along a Y axis under the control of the control unit 20.

The mover mechanism 24 moves the liquid ejecting head 26 back and forth along an X axis under the control of the control unit 20. The X axis intersects the Y axis along which the medium 12 is transported. The X axis and the Y axis are, for example, orthogonal to each other. The mover mechanism 24 of the first embodiment includes a substantially box shaped transport body 242 housing the liquid ejecting head 26, and a transport belt 244 to which the transport body 242 is fixed. Note that a configuration in which plural of the liquid ejecting heads 26 are mounted to the transport body 242, or a configuration in which the liquid holder 14 is mounted to the transport body 242 together with the liquid ejecting head 26, may also be adopted.

The liquid ejecting head 26 ejects ink supplied from the liquid holder 14 onto the medium 12 through plural nozzles under the control of the control unit 20. An image is formed on a surface of the medium 12 as desired by ejecting ink from the liquid ejecting head 26 onto the medium 12 at the same time as transporting the medium 12 using the transport mechanism 22 and moving the transport body 242 back and forth repeatedly. In the following explanation, an axis perpendicular to an X-Y plane is denoted the Z axis. The Z axis would typically be a vertical line. The X-Y plane is, for example, a plane running parallel to the surface of the medium 12.

Figure 2:
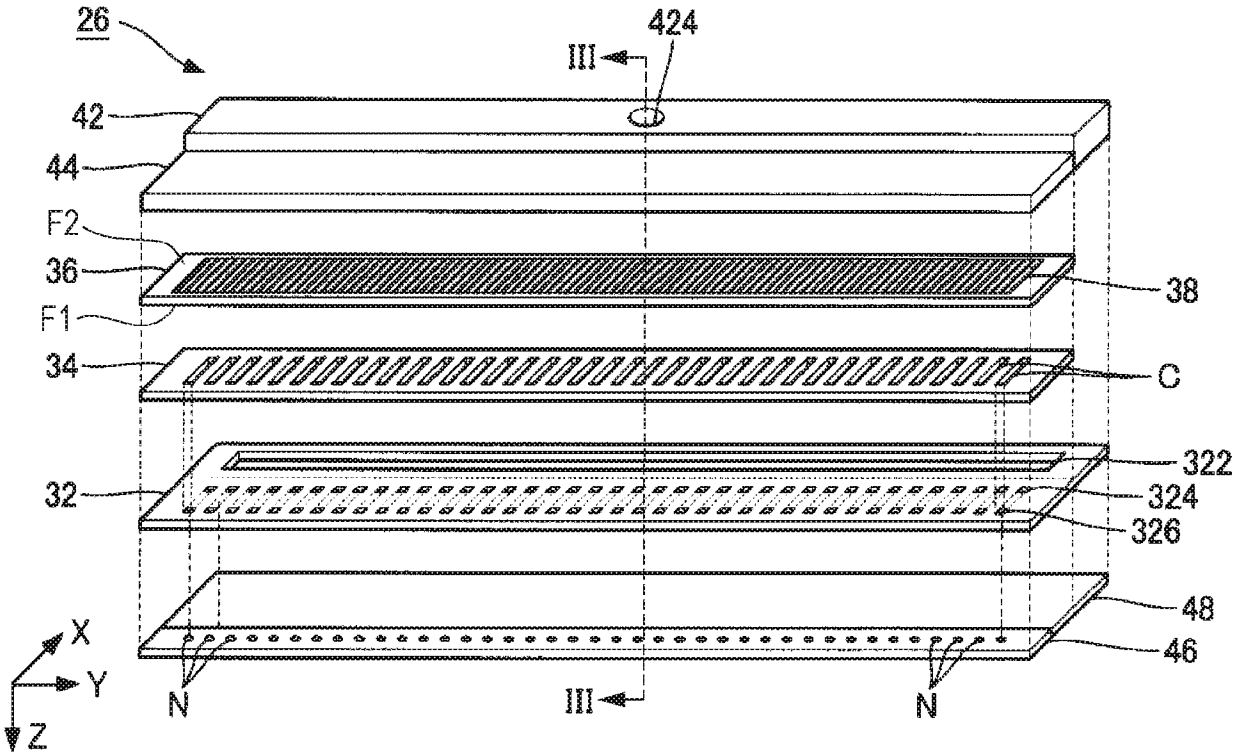
FIG. 2 is an exploded perspective view of a liquid ejecting head.
Figure 3:
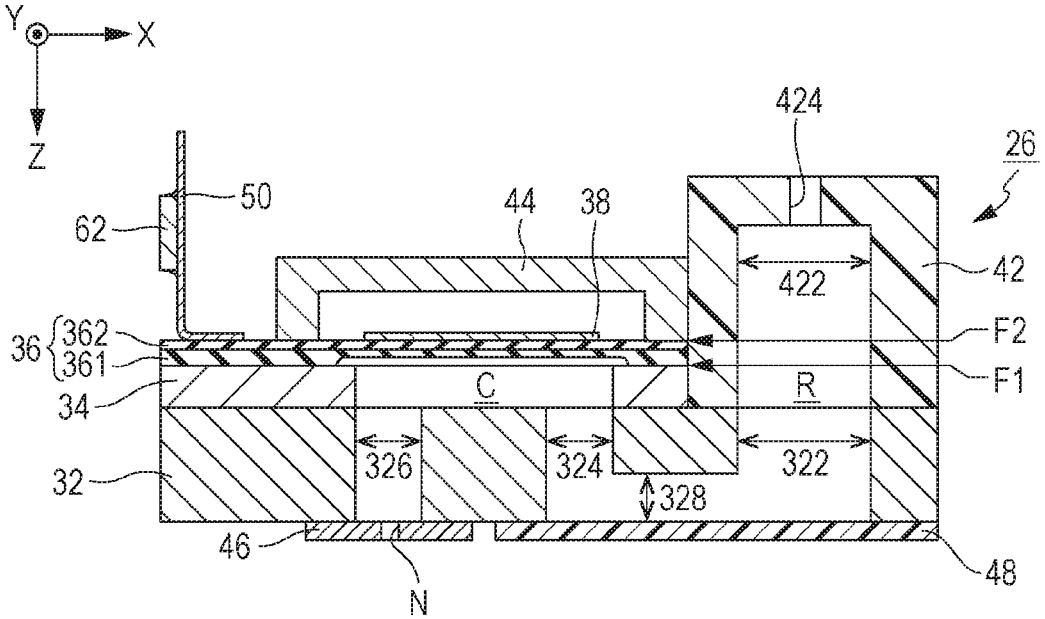
FIG. 3 is a cross-section of a liquid ejecting head.

FIG. 2 is an exploded perspective view illustrating the liquid ejecting head 26, and FIG. 3 is a cross-section taken along line III-III in FIG. 2. As illustrated in FIG. 2 and FIG. 3, the liquid ejecting head 26 includes a first flow path substrate 32. The first flow path substrate 32 is a plate shaped member with a substantially rectangular profile that is elongated along the Y axis. A second flow path substrate 34, a diaphragm 36, plural piezoelectric elements 38, a casing 42, and a protective substrate 44 are installed on a Z axis-negative direction face of the first flow path substrate 32. A nozzle substrate 46 and a vibration absorber 48 are installed on a Z axis-positive direction face of the first flow path substrate 32. The respective elements configuring the liquid ejecting head 26 are plate shaped members elongated along the Y axis, ostensibly similarly to the first flow path substrate 32, and are, for example, joined together using an adhesive.

As illustrated in FIG. 2, the nozzle substrate 46 is a plate shaped member formed with plural nozzles N arrayed along the Y axis direction. The nozzles N are through holes through which ink passes. The first flow path substrate 32, the second flow path substrate 34, and the nozzle substrate 46 are each formed by for example applying a semiconductor manufacturing technique such as etching to a monocrystalline silicon (Si) substrate. Note that the materials and manufacturing methods employed for the respective elements of the liquid ejecting head 26 may be freely selected.

The first flow path substrate 32 is a plate shaped member used to form an ink flow path. As illustrated in FIG. 2 and FIG. 3, the first flow path substrate 32 is formed with an opening 322, communication flow paths 324, and supply flow paths 326. The opening 322 is a through hole formed with an elongated profile along the Y axis in plan view along the Z axis so as to be continuous across the plural nozzles N. The communication flow paths 324 and the supply flow paths 326 are through holes formed individually corresponding to each of the nozzles N. As illustrated in FIG. 3, the Z axis-positive direction surface of the first flow path substrate 32 is formed with a relay flow path 328 formed continuously to the plural communication flow paths 324. The relay flow path 328 is a flow path through which the opening 322 and the plural communication flow paths 324 communicate with each other.

The casing 42 is a structural body manufactured by for example injection molding a resin material. The casing 42 is fixed to the Z axis-negative direction surface of the first flow path substrate 32. As illustrated in FIG. 3, the casing 42 is formed with a storage portion 422 and an inlet 424. The storage portion 422 is a recess with an outer profile aligned with the opening 322 in the first flow path substrate 32, and the inlet 424 is a through hole in communication with the storage portion 422. As can be seen in FIG. 3, a space in which the opening 322 in the first flow path substrate 32 and the storage portion 422 of the casing 42 are in communication with each other functions as a liquid reservoir R. Ink supplied from the liquid holder 14 passes through the inlet 424 and is held in the liquid reservoir R.

The vibration absorber 48 is an element provided to absorb changes in pressure in the liquid reservoir R, and is for example configured including a flexible film capable of undergoing elastic deformation. Specifically, the vibration absorber 48 is installed on the Z axis-positive direction surface of the first flow path substrate 32 so as to configure a bottom face of the liquid reservoir R and close off the opening 322, the relay flow path 328, and the plural communication flow paths 324 of the first flow path substrate 32.

As illustrated in FIG. 2 and FIG. 3, the second flow path substrate 34 is a plate shaped member formed with plural pressure chambers C corresponding to the different nozzles N. Specifically, the second flow path substrate 34 configures side faces of each of the pressure chambers C. The side faces of the pressure chambers C are faces intersecting the diaphragm 36. The plural pressure chambers C are arrayed along the Y axis. Each of the pressure chambers C is an elongated opening running along the X axis in plan view along the Z axis direction. An X axis-positive direction end portion of each of the pressure chambers C overlaps a single communication flow path 324 in plan view. An X axis-negative direction end portion of each of the pressure chambers C overlaps a single supply flow path 326 in plan view. The pressure chambers C are in communication with the corresponding nozzles N via the supply flow paths 326.

Figure 4:
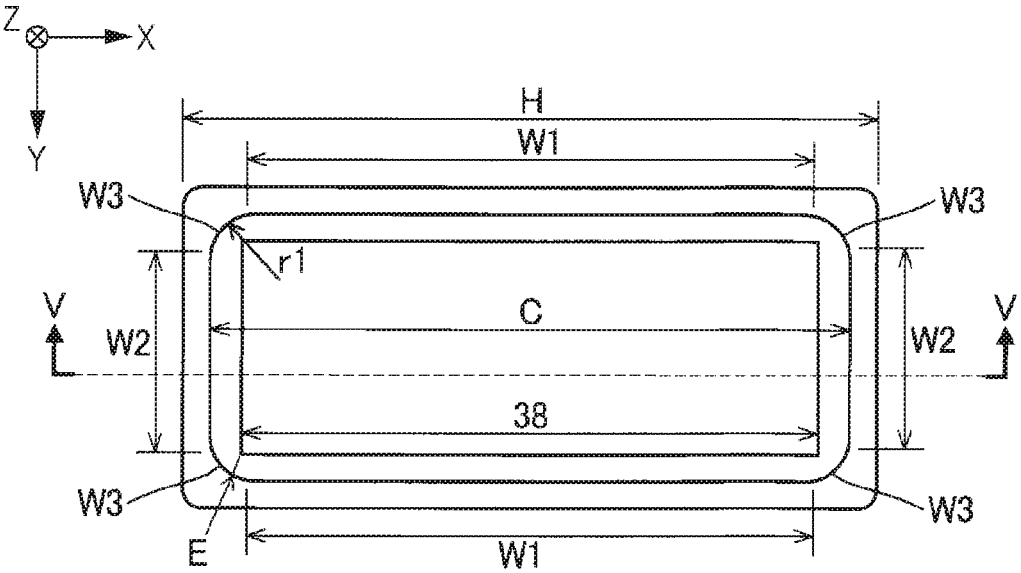
FIG. 4 is a plan view of the vicinity of a pressure chamber.

FIG. 4 is a plan view illustrating the vicinity of a pressure chamber C. As illustrated in FIG. 4, the side faces of the pressure chamber C include first planar faces W1, second planar faces W2, and curved faces W3. The first planar faces W1 are planar faces configuring side faces of the pressure chamber C that run along the X axis. The first planar faces W1 are respectively positioned on the Y axis-negative direction and the Y axis-positive direction sides. The first planar faces W1 configure planar faces corresponding to long edges of the pressure chamber C in plan view. The second planar faces W2 are planar faces configuring side faces of the pressure chamber C that run along the Y axis. The second planar faces W2 are respectively positioned on the X axis-negative direction and the X axis-positive direction sides. The second planar faces W2 configure planar faces corresponding to short edges of the pressure chamber C in plan view. As can be gathered from the above explanation, the side faces of each of the pressure chambers C include two of the first planar faces W1 opposing each other, and two of the second planar faces W2 opposing each other.

The curved faces W3 are faces that are continuous to the first planar faces W1 and the second planar faces W2, and are positioned at corners of the pressure chambers C in plan view. The corners of the pressure chambers C are positioned at internal angles of the pressure chambers C in plan view. Namely, four corners are present in each of the pressure chambers C since the pressure chambers C are substantially rectangular in profile in plan view. The side faces of each of the pressure chambers C thus include four of the curved faces W3 corresponding to the four corners. The centers of curvature of the respective curved faces W3 are positioned in the pressure chamber C in plan view along the Z axis direction. The curved faces W3 may also be said to configure parts of curved column faces positioned in the pressure chamber C and having an axial center running parallel to the Z axis. FIG. 4 illustrates a radius of curvature r1 of a curved face W3 in plan view. The radius of curvature is an indices indicating the degree of curvature of the curved face, and the greater the radius of curvature, the more gradual the curvature of the curved face.

The pressure chambers C including the curved faces W3 are, for example, formed by isotropic etching. The isotropic etching may be dry etching employing the Bosch process, or may be wet etching. For example, the pressure chambers C may be formed by applying mixed-acid isotropic etching to a monocrystalline silicon substrate. Examples of mixed acids include a 1:2:1 mixture of hydrofluoric acid, nitric acid, and acetic acid.

As illustrated in FIG. 3, the diaphragm 36 is installed on the opposite side surface of the second flow path substrate 34 to the first flow path substrate 32. The diaphragm 36 is a plate shaped member capable of undergoing elastic deformation. Specifically, the diaphragm 36 includes a first face F1 joined to the second flow path substrate 34, and a second face F2 on the opposite side to the first face F1. The diaphragm 36 of the first embodiment is, for example, configured by stacked layers of a first layer 361 formed of silicon oxide ($SiO_2$) and a second layer 362 formed of zirconium oxide ($ZrO_2$). The first layer 361 is positioned on the same side of the diaphragm 36 as the second flow path substrate 34, and the second layer 362 is positioned on the opposite side of the first layer 361 to the second flow path substrate 34. Namely, the second layer 362 is stacked on the Z axis-negative direction surface of the first layer 361.

As can be seen from FIG. 3, the first flow path substrate 32 and the diaphragm 36 oppose each other so as to be spaced apart with the respective pressure chambers C interposed therebetween. Each of the pressure chambers C is a space positioned between the first flow path substrate 32 and the diaphragm 36 in order to apply pressure to ink filling the pressure chamber C. The ink held inside the liquid reservoir R flows through the relay flow path 328, branches into the respective communication flow paths 324, and is supplied to fill the plural pressure chambers C at the same time. The pressure chambers C are in communication with the respective nozzles N through the first flow path substrate 32.

As illustrated in FIG. 2 and FIG. 3, the second face F2 of the diaphragm 36 is provided with plural of the piezoelectric elements 38 corresponding to the different nozzles N. Each of the piezoelectric elements 38 is a drive device used to change the pressure in the corresponding pressure chamber C. Specifically, the piezoelectric elements 38 are actuators that deform when supplied with a drive signal, and are each formed with an elongated profile along the X axis in plan view. The plural piezoelectric elements 38 are arrayed along the Y axis so as to correspond to the plural pressure chambers C. When the diaphragm 36 oscillates coordinated with the deformation of the piezoelectric elements 38, the pressure inside the pressure chambers C changes, such that the ink filling the pressure chambers C passes through the corresponding supply flow paths 326 and is ejected through the corresponding nozzles N.

Figure 5:
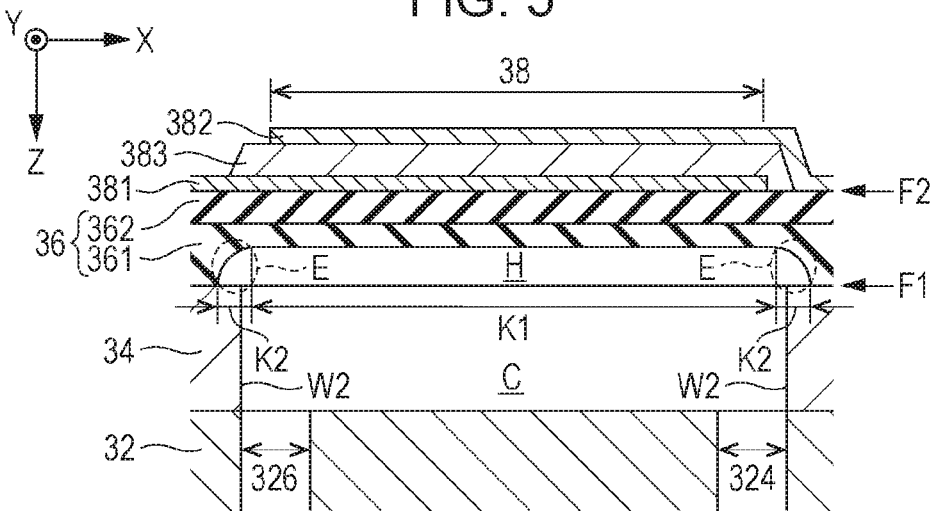
FIG. 5 is a cross-section of the vicinity of a pressure chamber.

As illustrated in FIG. 5, the piezoelectric elements 38 are configured by stacked bodies in which a piezoelectric layer 383 is interposed between a first electrode 381 and a second electrode 382 that oppose each other. The first electrodes 381 are individual electrodes formed corresponding to each of the piezoelectric elements 38 on the second face F2 of the diaphragm 36. Each of the first electrodes 381 is supplied with a drive signal to drive the corresponding piezoelectric element 38. The piezoelectric layer 383 is formed from a ferroelectric piezoelectric material such as lead zirconate titanate. The second electrode 382 is a common electrode provided continuously across the plural piezoelectric elements 38. The second electrode 382 is applied with a predetermined reference voltage. Namely, the piezoelectric layer 383 is applied with a voltage corresponding to the difference between the reference voltage and the drive signal. Portions where a first electrode 381, the second electrode 382, and a piezoelectric layer 383 overlap in plan view function as the piezoelectric elements 38. The piezoelectric elements 38 are an example of drive devices that change the pressure inside the pressure chambers C. When the diaphragm 36 oscillates in communication with the deformation of the piezoelectric elements 38, the pressure of the ink in the corresponding pressure chambers C change, such that the ink filling the pressure chambers C passes through the corresponding communication flow paths 324 and is ejected to the exterior through the corresponding nozzles N. Note that a configuration in which the first electrode 381 is configured by a common electrode and the second electrodes 382 are configured as separate electrodes for each of the piezoelectric elements 38, or a configuration in which both the first electrodes 381 and the second electrodes 382 are configured by individual electrodes, may be adopted.

FIG. 5 is an enlarged cross-section illustrating the vicinity of the pressure chamber C illustrated in FIG. 3. FIG. 3 is a cross-section sectioned along line V-V in FIG. 4. As illustrated in FIG. 3 and FIG. 5, the first face F1 of the diaphragm 36 is formed with recesses H that are indents in the first face F1. As illustrated in FIG. 4, the recesses H are formed at positions overlapping the pressure chambers C in plan view. Specifically, the pressure chambers C are positioned inside the respective recesses H in plan view. Accordingly, as illustrated in FIG. 5, spaces E configured by a diaphragm 36 side surface of the second flow path substrate 34 and inner walls of the recesses H are formed. The spaces E are spaces that do not overlap with the pressure chambers C in plan view. As illustrated in FIG. 4, the spaces E are formed around the entire periphery of the respective recesses H. In other words, the spaces E are formed so as to surround the peripheries of the pressure chambers C in plan view. The piezoelectric elements 38 are positioned inside the pressure chambers C in plan view. Namely, the piezoelectric elements 38 are also positioned inside the respective recesses H.

As illustrated in FIG. 5, in the first embodiment, the recesses H are formed in the first layer 361. Specifically, the recesses H are spaces each configured by a bottom face K1 and side faces K2. The bottom face K1 is a planar face parallel to the first face F1, and is positioned spaced apart from the first face F1 in the Z axis-negative direction. The side faces K2 are curved faces running continuously from the first face F1 to the bottom face K1. The side faces K2 are formed as curved faces running around the entire periphery of each of the recesses H. The centers of curvature of the side faces K2 are positioned on the pressure chamber C side of the side faces K2 as viewed in cross-section. In other words, the side faces K2 may be said to configure parts of curved column faces positioned inside the recess H and having an axial center running parallel to the Y axis direction.

Figure 6:
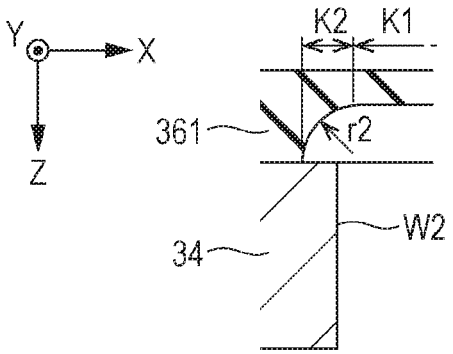
FIG. 6 is a cross-section of the vicinity of a curved face of a recess.

FIG. 6 is an enlarged view illustrating the vicinity of a side face K2 of the recess H illustrated in FIG. 5. FIG. 6 illustrates a radius of curvature r2 at a corner of the recess H as viewed in cross-section. Corners of the recess H are present at both ends of the recess H as viewed in cross-section. In the first embodiment, the radius of curvature r1 of the corner of the pressure chamber C illustrated in plan view in FIG. 4 is larger than the radius of curvature r2 of the corner of the recess H illustrated in cross-section in FIG. 6.

The protective substrate 44 illustrated in FIG. 2 and FIG. 3 is a plate shaped member that protects the plural piezoelectric elements 38 and reinforces the mechanical strength of the second flow path substrate 34 and the diaphragm 36. Namely, the protective substrate 44 is installed on the opposite side of the second flow path substrate 34 to the first flow path substrate 32. The plural piezoelectric elements 38 are installed between the protective substrate 44 and the diaphragm 36. The protective substrate 44 is, for example, formed from silicon (Si).

As illustrated in FIG. 3, for example a wiring substrate 50 is joined to a surface of the diaphragm 36. The wiring substrate 50 is a mounted component formed with plural wires used to electrically couple the control unit 20 or a power source circuit to the liquid ejecting head 26. The wiring substrate 50 is preferably configured by a flexible printed circuit (FPC), flexible flat cable (FFC), or the like so as to be flexible. As illustrated in FIG. 3, the liquid ejecting head 26 includes a drive circuit 62 mounted to the wiring substrate 50. The drive circuit 62 supplies the drive signals to the respective piezoelectric elements 38.

Envisage a configuration (referred to hereafter as a comparative example) in which the corners of the pressure chambers C have an angular shape in plan view. Namely, in the comparative example, the first planar faces W1 and the second planar faces W2 intersect each other at the corners. In the comparative example, the adhesive employed to join the first flow path substrate 32 and the second flow path substrate 34 together may travel along the corners in the pressure chambers C by capillary force arising at the corners, and thereby adhere to the diaphragm 36. Such adhesion of the adhesive might change the oscillation characteristics of the diaphragm 36, resulting in variation in ink ejection characteristics through the nozzles. The ejection characteristics include for example ejection amount, ejection direction, and ejection speed. By contrast, in the first embodiment, the side faces of the pressure chambers C include the curved faces W3 at the corners, enabling capillary force arising at the corners to be reduced, and the likelihood of adhesive traveling along the corners and adhering to the diaphragm 36 to be reduced. This enables variation in ejection characteristics caused by adhesive coated on the surface of the second flow path substrate 34 to be reduced.

Furthermore, in the first embodiment, since the pressure chambers C are positioned inside the recesses H of the diaphragm 36 in plan view, even supposing the adhesive were to travel along the corners of the pressure chambers C, the adhesive would enter the spaces E between the surface of the second flow path substrate 34 and the inner walls of the recesses H. Namely, adhesive can be suppressed from adhering to the diaphragm 36 in regions overlapping the piezoelectric elements 38. This realizes a clear advantageous effect of reducing variation in ejection characteristics caused by adhesive coated on the surface of the second flow path substrate 34.

The occurrence of capillary force at the corners is sufficiently reduced by the configuration of the first exemplary embodiment, in which the radius of curvature r1 of the corners of the pressure chambers C in plan view is larger than the radius of curvature r2 of the corners of the recesses H as viewed in cross-section. This enables the likelihood of adhesive traversing the corners of the pressure chambers C and adhering to the diaphragm 36 to be sufficiently reduced. However, the radius of curvature r1 may be set smaller than the radius of curvature r2. In the first embodiment, positioning the piezoelectric elements 38 inside the recesses H in plan view enables the diaphragm 36 to be displaced sufficiently, in contrast to configurations in which the recesses H are positioned outside the piezoelectric elements 38 in plan view.

B. Second Embodiment

Explanation follows regarding a second embodiment. In the following explanation, elements with similar functions to those of the first embodiment are allocated the same reference numerals as in the explanation of the first embodiment, and detailed explanation regarding such elements will be omitted as appropriate.

Figure 7:
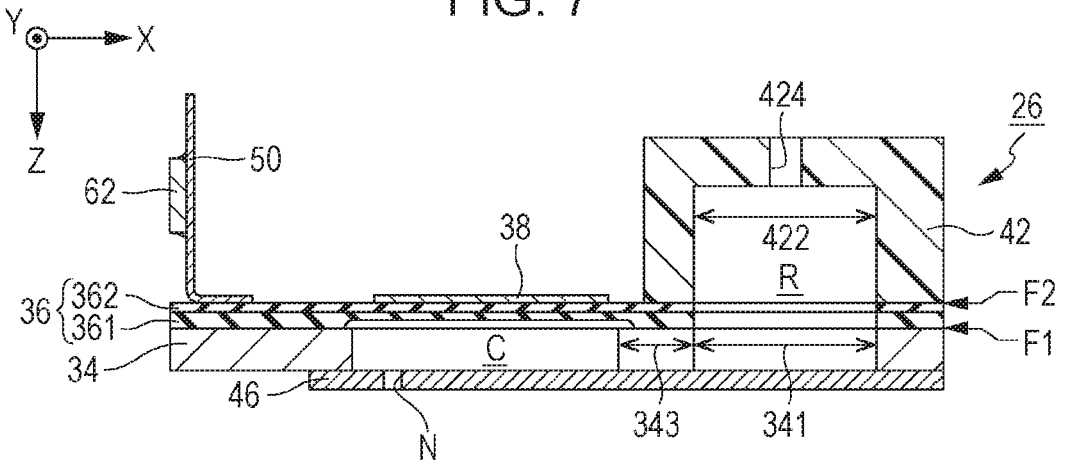
FIG. 7 is a cross-section of a liquid ejecting head according to a second embodiment.
Figure 8:
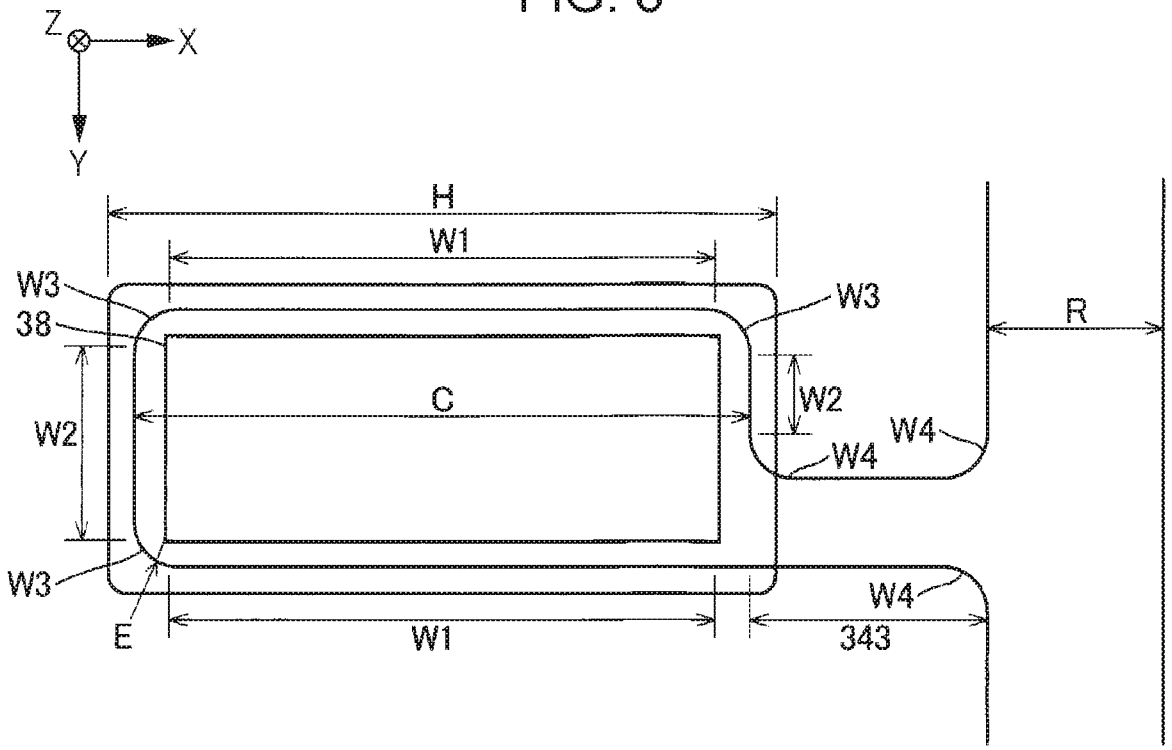
FIG. 8 is a plan view of the vicinity of a pressure chamber according to the second embodiment.

FIG. 7 is a cross-section illustrating a liquid ejecting head 26 according to the second embodiment. FIG. 8 is a plan view illustrating the vicinity of the pressure chamber C illustrated in FIG. 7. The configuration of the side faces of the pressure chambers C including the curved faces W3 and the configuration of the diaphragm 36 including the recesses H are similar to those of the first exemplary embodiment. As illustrated in FIG. 7, the first flow path substrate 32 is omitted from the liquid ejecting head 26 of the second embodiment. Namely, the nozzle substrate 46 is installed to the opposite side of the second flow path substrate 34 to the diaphragm 36. The casing 42 of the second embodiment is installed to the second face F2 of the diaphragm 36. Similarly to in the first embodiment, the casing 42 is formed with the storage portion 422 and the inlet 424. An opening 341 formed through both the second flow path substrate 34 and the diaphragm 36 is in communication with the storage portion 422 and thereby functions as a liquid reservoir R. Note that as viewed in plan view along the Z axis direction, the opening 341 is a through hole formed with an elongated profile along the Y axis so as to run continuously along the plural nozzles N.

As illustrated in FIG. 7 and FIG. 8, the second flow path substrate 34 of the second embodiment is formed with communication flow paths 343. The communication flow paths 343 are through holes that are formed corresponding to each of the pressure chambers C and through which the respective pressure chambers C and the liquid reservoir R communicate with each other. As illustrated in FIG. 8, the width of each of the communication flow paths 343 in the Y axis direction in which the liquid reservoir R extends is smaller than the width of the pressure chambers C in the Y axis direction. Namely, flow path resistance of the communication flow paths 343 is greater than the flow path resistance of the pressure chambers C. The communication flow paths 343 thus function as flow constricting paths to suppress backflow of ink from the pressure chambers C to the liquid reservoir R.

As illustrated in FIG. 8, the side faces of the communication flow paths 343 include curved faces W4. The side faces of the communication flow paths 343 are faces that intersect the diaphragm 36. Specifically, the side faces of each of the communication flow paths 343 include curved faces W4 that are continuous to the corresponding side faces of the liquid reservoir R, and a curved face W4 that is continuous to the corresponding side face of the pressure chamber C. The centers of curvature of the curved faces W4 that are continuous to the side faces of the liquid reservoir R are positioned outside the liquid reservoir R in plan view. The center of curvature of the curved face W4 that is continuous to the side face of the pressure chamber C is positioned outside the pressure chamber C in plan view.

The second embodiment exhibits similar advantageous effects to those of the first exemplary embodiment. Note that a configuration in which side faces of the communication flow paths 343 and side faces of the liquid reservoir R were coupled together so as to form an angular shape therebetween would be vulnerable to damage as a result of stress concentrating at the coupling locations. By contrast, in the second embodiment, since the side faces of the communication flow paths 343 include the curved faces W4 continuous to the side faces of the liquid reservoir R, stress arising at the coupling locations between the communication flow paths 343 and the liquid reservoir R is reduced. This enables the likelihood of damage to these coupling locations to be reduced.

C. Modified Examples

Various modifications may be made to the embodiments described above. Explanation follows regarding specific modified examples that may be applied to the above embodiments. Note that any two or more configurations selected as desired from the following examples may be applied in combination provided that they are not contradictory.

1. Although the diaphragm 36 is configured by the first layer 361 and the second layer 362 in the embodiments described above, the configuration of the diaphragm 36 is not limited thereto. For example, the diaphragm 36 may be configured by a single layer structure, or the diaphragm 36 may be configured by three or more layers.

2. Although examples have been given in which the side faces K2 of the recesses H of the diaphragm 36 are configured by curved faces in the embodiments described above, the side faces of the recesses H may be configured by planar faces. For example, the recesses H may include planar side faces K2 that form an angle from the first face F1 toward the bottom face K1 of the recess H. Alternatively, portions of the side faces K2 of the recesses H that are continuous to the bottom face K1 may be configured by curved faces, and portions of the side faces K2 of the recesses H that run continuously from the first face F1 to the curved faces may be configured by planar faces.

Figure 9:
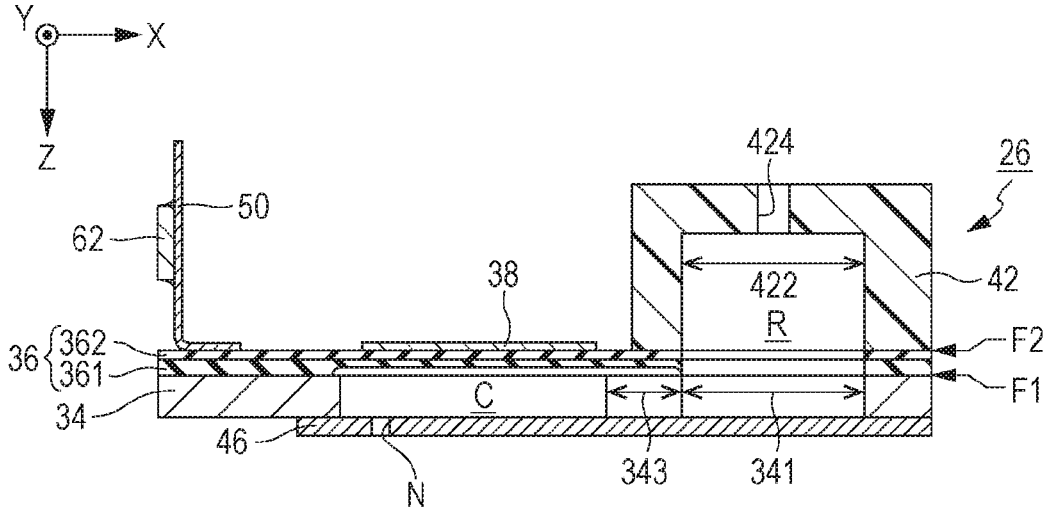
FIG. 9 is a cross-section of a liquid ejecting head according to a modified example.

3. As illustrated in FIG. 9, in the configuration of the second embodiment, the recesses H of the diaphragm 36 may be formed so as to overlap the communication flow paths 343. In the configuration illustrated in FIG. 9, each of the recesses H is formed from a position overlapping the corresponding pressure chamber C in plan view to an X axis-positive direction end portion of the corresponding communication flow path 343.

4. Although examples have been given in the above embodiments in which the liquid ejecting apparatus 100 is a serial device in which the transport body 242 installed with the liquid ejecting head 26 moves back and forth, the disclosure may also be applied to a line type liquid ejecting apparatus in which plural nozzles N are distributed so as to span the entire width of the medium 12.

5. The drive devices that cause the liquid in the pressure chambers C to be ejected through the nozzles N are not limited to the piezoelectric elements 38 in the examples of the embodiments described above. For example, heat generating elements that change the pressure by heating in order to generate air bubbles inside the pressure chambers C may be employed as drive devices. As is understood from the above examples, "drive device" is a broad term encompassing elements that cause liquid inside the pressure chambers C to be ejected through the nozzles N, and there is no limitation to a specific configuration or operation method, be it a piezoelectric method or a heat-based method.

6. The liquid ejecting apparatus 100 described in the above embodiments may be employed in various devices, for example fax machines or photocopiers, as well as in dedicated printing equipment. The liquid ejecting apparatus of the disclosure is not limited to printing applications. For example, a liquid ejecting apparatus that ejects a colored solution may be employed as manufacturing equipment used to form color filters for display devices such as liquid crystal display panels. Alternatively, a liquid ejecting apparatus that ejects a conductive solution may be employed as manufacturing equipment used to form wiring on wiring substrate or electrodes. Alternatively, a liquid ejecting apparatus that ejects a biological organic material solution may be employed as manufacturing equipment used to form biochips or the like.

What is claimed is:

1. A liquid ejecting head comprising:

a flow path substrate configuring a side face of a pressure chamber in communication with a nozzle through which a liquid is ejected;

a diaphragm including a first face joined to the flow path substrate and a second face on an opposite side of the diaphragm to the first face; and a drive device provided on the second face and configured to change pressure in the pressure chamber, wherein a corner of the side face of the pressure chamber includes a curved face having a center of curvature positioned in the pressure chamber in plan view, a recess is formed in the first face, the pressure chamber is positioned inside the recess in plan view, and a side face of the recess includes a curved face continuous to a bottom face of the recess, and a radius of curvature of a corner of the pressure chamber in plan view is larger than a radius of curvature of a corner of the recess as viewed in cross-section.

2. The liquid ejecting head according to claim 1, wherein the flow path substrate is formed with a liquid reservoir that supplies a liquid to the pressure chamber, and a communication flow path through which the pressure chamber and the liquid reservoir communicate with each other, and a width of the communication flow path in an extension direction of the liquid reservoir is smaller than a width of the pressure chamber in the extension direction.

3. The liquid ejecting head according to claim 2, wherein a side face of the communication flow path includes a curved face continuous to a side face of the liquid reservoir.

4. The liquid ejecting head according to claim 1, wherein the drive device is positioned inside the recess in plan view.

5. A liquid ejecting apparatus comprising:

the liquid ejecting head according to claim 1; and a controller that controls the liquid ejecting head.

* * * * *